US006095342A

United States Patent [19]

Ashcraft

[11] Patent Number: 6,095,342

[45] **Date of Patent: *Aug. 1, 2000**

[54] HAND HELD CLASSIFYING DEVICE

[76] Inventor: Clarence W. Ashcraft, R.R. 5, Box 207, Mt. Vernon, Ill. 62864

[ * ] Notice: This patent issued on a continued prosecution application filed under 37 CFR 1.53(d), and is subject to the twenty year patent term provisions of 35 U.S.C. 154(a)(2).

[21] Appl. No.: 08/582,279

[22] Filed: Jan. 3, 1996

[51] Int. Cl.[7] ..... B03B 5/52

[52] U.S. Cl. ..... 209/447; 209/490; 209/494

[58] Field of Search ..... 209/13, 44, 446, 209/447, 484, 485, 490, 494, 495

[56] References Cited

U.S. PATENT DOCUMENTS

| | | | |
|---|---|---|---|
| 32,115 | 4/1861 | Brock | 209/447 |
| 37,758 | 2/1863 | Kendall, Sr. | 209/447 |
| 585,989 | 7/1897 | Sletcher | 209/447 |
| 634,120 | 10/1899 | Moore | 209/447 |
| 646,382 | 3/1900 | Collins | 209/447 |
| 664,066 | 12/1900 | Tobin | 209/447 |
| 667,969 | 2/1901 | Campbell | 209/447 |
| 799,059 | 9/1905 | Johansen | 209/447 |
| 923,392 | 6/1909 | White | 209/447 |
| 1,064,853 | 6/1913 | Ord | 209/447 |
| 1,064,854 | 6/1913 | Ord | 209/447 |
| 1,192,806 | 7/1916 | Weigand | 209/494 X |
| 1,292,364 | 1/1919 | Ord | 209/447 |
| 1,419,405 | 6/1922 | Ord | 209/447 |
| 1,444,752 | 2/1923 | Ord | 209/447 |
| 1,948,797 | 2/1934 | Nicolai | 209/447 |
| 1,966,359 | 7/1934 | Ryan | 209/447 |
| 1,972,645 | 9/1934 | Danills | 209/447 |
| 2,630,226 | 3/1953 | Streng | 209/447 |
| 3,059,776 | 10/1962 | Smith | 209/447 |
| 3,855,119 | 12/1974 | Stephenson | 209/447 |
| 3,899,418 | 8/1975 | Lawrence et al. | 209/447 |
| 4,162,969 | 7/1979 | Lagel | 209/447 |
| 4,273,648 | 6/1981 | Legg | 209/447 |
| 4,289,241 | 9/1981 | Litrap | 209/447 X |
| 4,319,994 | 3/1982 | Morgan | 209/447 |
| 4,400,269 | 8/1983 | Gordon, Jr. | 209/447 |
| 4,671,868 | 6/1987 | Ottrock | 209/447 X |
| 5,190,158 | 3/1993 | Remias | 209/447 X |

*Primary Examiner*—Tuah B. Nguyen

[57] ABSTRACT

A gold pan (20) and classifying device for separating granular materials of varying specific gravities of generally rectangular shape including two substantially vertical side walls (21), two sloping side walls (22) with laminated plate (24) and edge (25) construction, a gold concentrating trap (33) at the bottom of the four walls with volume of less than one tenth of one percent of total pan volume, a bottom opening (23) and seal (28) for removal of gold concentrates from the concentrating trap (33) through the pan bottom while waste materials are retained in the pan (20). The unique design enables even a beginner to achieve proficiency in minutes while processing much more material than previously possible with existing pans, either with or without the assistance of a liquid medium and with little or no potential for losing fine gold.

8 Claims, 5 Drawing Sheets

HAND HELD CLASSIFYING DEVICE

BACKGROUND

1. Field of Invention

This invention relates to hand held devices for separating granular materials according to relative specific gravities, with or without the use of a liquid medium, especially those used in gold panning to recover precious metals from native granular materials.

2. Description of Prior Art

The object of panning for gold is to retrieve as much gold as possible, in any given time period from granular materials such as gravel, sand or clay without losing any gold in the process, especially "flour gold" which constitutes the majority of gold panned. "Flour gold" is fine pieces of gold that are so small that they are almost undetectable with the unaided eye.

During the past 200 years or more many problems associated with gold panning have been recognized and some attempts have been made to solve them. These problems can be lumped into general areas such as:

1) SPEED:

a) Panning time can be reduced by simply not processing most of the waste materials. Gold particles are usually small and much of the waste material is in large pieces. Prescreening of your raw supply of granular materials can eliminate 80% to 95% of waste before panning begins. Screening of materials in the gold pan as suggested by LITRAP (U.S. Pat. No. 4,289,241—Sep. 15, 1981) and REMIAS (U.S. Pat. No. 5,190,158—Mar. 2, 1993) is not only counterproductive, but requires much more expensive equipment to accomplish.

b) The process of gold panning involves repeated cycles of shaking the pan to settle gold toward the bottom followed by tilting the pan then washing waste materials off the top and out of the pan. Because of a declining volume of materials left in the pan, each successive wash cycle removes a smaller volume of waste material from the pan. Each time you finish a shaking cycle you must allow the materials to settle into a solid mass before starting the wash cycle. More time and more energy are required to shake the materials loose again to restart the concentration process. Materials shift during the wash cycle thereby destroying part of the gain made during the previous shaking cycle.

The farther you go, the slower the process becomes. For this reason, experienced panners save time by working down to a certain level of concentration then collecting concentrates from many pans into a second device before doing the final separation of gold from the remaining waste materials.

Inventor LITRAP (U.S. Pat. No. 4,289,241—Sep. 15, 1981) by concentrating on the ability to do final gold separation in his pan, sacrificed speed and efficiency and also created other problems.

c) The volume of gold in a pan of granular materials is usually less than one tenth of one percent of total pan volume. It does not take long to settle the gold to the bottom of the pan but once it gets there it is not very concentrated and it still has more than 99 percent waste materials sitting on top of it.

Much time and energy is used while trying to get the gold all together in one place in the pan's bottom and in washing the waste material out of the pan. As the total volume of material in the pan decreases, it becomes more difficult to wash waste material out without also losing gold.

Some inventors have tried to solve the concentration problem by creating recesses, channels, traps, pockets, indentations or some other kind of depression in the bottom of the pan where the depression constitutes only a small fraction of the surface area of the pan bottom. If all the gold could be moved into the depression then it would be much more concentrated than when it was spread all over the pan's bottom.

Inventions with bottom depressions include:

Sletcher: U.S. Pat. No. 585,989: Jul. 6, 1897

Ord: U.S. Pat. No. 1,064,853: Jun. 17, 1913

Ord: U.S. Pat. No. 1,064,854: Jun. 17, 1913

Ord: U.S. Pat. No. 1,419,405: Jun. 13, 1922

Ord: U.S. Pat. No. 1,444,752: Feb. 6, 1923

Nicolai: U.S. Pat. No. 1,948,797: Jul. 25, 1932

Streng: U.S. Pat. No. 2,630,226: Jan. 10, 1951

Lawrence et al: U.S. Pat. No. 3,899,418: Aug. 12, 1975

Legg: U.S. Pat. No. 4,273,648: Jun. 16, 1981

Morgan: U.S. Pat. No. 4,319,994: Mar. 16, 1982

Gordon Jr.: U.S. Pat. No. 4,400,269: Aug. 23, 1983

None of these inventions with bottom depressions have achieved commercial success perhaps because they did not perform as anticipated. There are two reasons for poor performance.

First, when the pan is first filled the depression fills quickly with mostly waste materials. After the gold particles settle to the bottom the pan is shaken from side to side to try and move the pieces of gold to the depression area. Gold can move around the pan bottom many times and never pass over the depression. Even when it passes over the area of the depression it is not likely to enter the depression because the depression is already packed solid with mostly heavy waste materials. The panner can't see where the gold particles are.

Second, even when gold particles enter the depression it is likely they will not stay there. As the panner tilts the pan to wash out waste materials everything in the pan shifts and gold is very likely to spill out of the depression again. Contrary to expectations the depression actually seems to be a hindrance rather than a help in concentration.

Johnson: U.S. Pat. No. 799,059: Sep. 12, 1905 utilized a round pan that was conical in shape. In the tip of the cone was a copper plate. The object was to coat the copper plate with mercury which absorbed fine gold but could not hold larger nugget pieces of gold. Although the cone shape made it easier to get the gold into a small area, the round shape still created turbulence with the potential for loss of gold. The problems of washing off waste materials and recovering all the gold is still there and perhaps even complicated by the mercury coated plate.

d) Some inventors have attempted to resolve the need to wash waste materials out of the pan by providing a means for removing gold concentrates through the bottom of the pan.

Inventions with means for bottom removal include:

Kendall, Sr.: U.S. Pat. No. 37,758: Feb. 24, 1863

Ord: U.S. Pat. No. 1,292,364: Jan. 21, 1919

Nicolai: U.S. Pat. No. 1,948,797: Jul. 25, 1932

Streng: U.S. Pat. No. 2,630,226: Jan. 10, 1951

Legg: U.S. Pat. No. 4,273,648: Jun. 16, 1981

Morgan: U.S. Pat. No. 4,319,994: Mar. 16, 1982

None of these inventions with bottom removal have achieved commercial success for three reasons.

First, as the prior discussion has shown, noone has been able to overcome the problems created by the pan bottom and effectively concentrate the gold in a small area above the pan bottom opening.

Second, prior bottom opening devices were complicated and did not function as well as anticipated.

Third, prior bottom opening devices were too expensive to manufacture and could not be produced at a price acceptable to the marketplace. A simpler opening and a seal that could be pulled out and pressed in without the need for screws, bolts, pins, hinges, etc. would have been a significant improvement to any of these designs.

e) Earlier pans had smooth sides and bottoms. If a panner was too aggressive in shaking the pan there was a risk of losing gold by having it slide up the side and over the top of the pan.

Several inventors have designed indentations, riffles, ridges, corrugations and other irregular shapes into the sides and bottoms of their pans. They include:

Brock: U.S. Pat. No. 32,115: Apr. 23, 1861
Sletcher: U.S. Pat. No. 585,989: Jul. 6, 1897
Moore: U.S. Pat. No. 634,120: Oct. 3, 1899
Collins: U.S. Pat. No. 646,382: Mar. 27, 1900
Tobin: U.S. Pat. No. 664,066: Dec. 18, 1900
Campbell: U.S. Pat. No. 667,969: Feb. 12, 1901
White: U.S. Pat. No. 923,392: Jun. 1, 1909
Ryan: U.S. Pat. No. 1,966,359: Dec. 7, 1932
Danills: U.S. Pat. No. 1,972,645: Oct. 6, 1932
Smith: U.S. Pat. No. 3,059,776: Oct. 23, 1962
Stephenson: U.S. Pat. No. 3,855,119: Dec. 17, 1974
Lagel: U.S. Pat. No. 4,162,969: Jul. 31, 1979
Litrap: U.S. Pat. No. 4,289,241: Sep. 15, 1981
Gordon Jr.: U.S. Pat. No. 4,400,269: Aug. 23, 1983
Ottrock: U.S. Pat. No. 4,671,868: Jun. 9, 1987
Remias: U.S. Pat. No. 5,190,158: Mar. 2, 1993

Most inventors use the riffles, etc. to retard the movement of gold up the sides of the pan during the shaking, tilting and washing cycles. Some are to provide supports for various screening inserts for the pans. Gordon Jr. (U.S. Pat. No. 4,400,269: Aug. 23, 1983) and Remias (U.S. Pat. No. 5,190,158: Mar. 2, 1993) used some of their beads, riffles, risers, and ribs to create "turbulence" for breaking up granular materials.

Turbulence is counterproductive because it consumes energy with no offsetting benefits; it can cause gold to move up in the pan rather than down toward the desired area of concentration and it can dislodge fine gold, allowing it to be washed out of the pan along with waste mateirals.

Although most of these riffle, ridge, etc. designs have some beneficial effects when the pan is full of granular materials there are also some unrecognized disadvantages.

These designed features that resist the movement of gold up the sides and out of the pan also resist the movement of waste materials up and out of the pan, especially when the volume of materials in the pan becomes small. During the final stages of the concentrating process it becomes more difficult to wash the fine heavy particles of waste material out of the pan without also losing gold. This forces the panner to slow down the process, not only wasting time, but also wasting energy. There is a continuing need to stop washing and shake the gold back to the bottom of the pan again.

When the volume of materials remaining in the pan is low there is not enough to cover the riffles from end to end and there is no means to spread the granular material level along the riffles. Water tends to flow around the edges of the granular materials and over the riffles creating many points of turbulence that dislodge fine gold and washes it out of the pan.

2) SKILL: There are world championship competitions held to see who has developed the best skills of gold panning. Many beginning panners have finished a pan of materials only to find no gold, because they accidently washed it all out during the panning process. Professional panners will tell you that they have special little movements they use that others do not recognize. Some partime panners pan for weeks, months or even years before becoming proficient.

3) FLOATING GOLD: One process for separating gold from finely ground materials is to introduce water and an oily substance into the material then blow air bubbles that move up to the surface. Gold has a great affinity for oily substances like the oil on your hand that produces fingerprints and handprints.

The oil not only clings to the gold, thereby reducing its relative specific gravity, but it also enhances the strength of the surface tension of water, especially inside the bubbles. The fine gold, coated with oil, is carried by the bubbles to the surface where it can be skimmed off and refined.

Many experienced panners have looked into the bottom of their pan and have seen small pieces of gold called colors. After swirling the water and pouring it off, the colors were gone from the pan. Some have even swirled their pans and before pouring the water off they have seen the small pieces of gold floating on the surface like chips of wood. The first time you see it, it is difficult to believe.

All prior art practically guarantees that you will touch the inside of the gold pan with your fingers thereby leaving oil to attach itself to fine gold particles. Special movements of the pan either during shaking or during the washing cycles require a grip on the inside of the pan. Gordon Jr. (U.S. Pat. No. 4,400,269—Aug. 23, 1983) even designed his pan for the thumb to be gripping inside the pan from start to finish. Remias (U.S. Pat. No. 5,190,158: Mar. 2, 1993) designed his pan to also serve as a shovel by gripping either end or either side. Litrap (U.S. Pat. No. 4,289,241: Sep. 15, 1981) recommends using your hands to pick rocks and pebbles out of the pan and using your fingers to stir the materials in the pan. These three designers are practically guaranteeing some loss of fine gold.

4) INTERNAL FLOW DESIGN:

a) When gold is being concentrated in granular materials, each individual particle must move from a widely dispersed position to an area of high concentration, usually somewhere in the lowest part of the pan. If the granular materials are sitting at rest, no movement of the gold particles can occur.

If the granular materials are shaken sufficiently they will become "fluidized". In this state, each particle can move independently of adjacent particles and the gold particles being heavier will tend to migrate downward until they come in contact with a surface of the pan. The deeper the gold travels, the harder it becomes for it to move because of the weight of materials on top of it.

If a particle of gold comes to rest on a level surface its progress toward the desired area of concentration is stopped and much energy is required to shake the pan hard enough to move the particle sideways because of the weight of material on top of it.

If a particle of gold comes to rest on a downward sloping surface then only a small amount of energy needs to be spent to encourage it to progress toward the desired area of concentration. If the particle of gold bumps into any obstruction as it moves along the downward sloping surface, additional energy is required to pass this obstruction on the way to the desired area of concentration.

Pan bottoms as well as shelf areas, supports, beads, ridges, risers, steps, ribs, valleys, etc. impede the progress of gold particles toward the desired area of concentration. They require the expenditure of extra energy and even then it is difficult to control the direction of movement of the gold particles.

Pan designs that rely heavily on these internal riffle designs include:

Remais: U.S. Pat. No. 5,190,158: Mar. 2, 1993

Gordon Jr.: U.S. Pat. No. 4,400,269: Aug. 23, 1983

Litrap: U.S. Pat. No. 4,289,241: Sep. 15, 1981 b) As mentioned above, the gold particles can only progress toward the desired area of concentration when they are in a fluidized state. In gold panning, whether you are using a liquid medium or not, this is accomplished by shaking the pan so that the materials move back and forth across the pan or around the pan in a motion called laminar flow.

Laminar flow is occuring when the materials at or near the surface are moving easier and farther than the materials in the lower levels. Each successive lower layer moves slower and less farther than the layer above it. If the pan is not being shaken hard enough, the lowermost levels may not be fluidized at all and therefore no further concentration is occuring there.

The best laminar flow occurs when all the materials in the pan are moving in the same direction and are free of turbulence. This is when the greatest concentration of gold particles is occuring with the least expenditure of energy.

Pans with curved surfaces and with riffles, grooves, notches, holes and troughs interfere with laminar flow because they create turbulence. Turbulence not only is counterproductive to concentrating as shown several times in the preceding writing but it also consumes extra energy with no offsetting benefit. Sidewalls that open or converge either up and down or from end to end cause pinching and turbulence.

Parallel, flat vertical sides provide an ideal structure for turbulence-free, laminar flow. Gordon Jr. in U.S. Pat. No. 4,400,269: Aug. 23, 1983 used substantially vertical sides for a different reason. However, the necessity of thumb holes and pouring troughs which he designed into these sides to overcome some problems created yet other new problems. Not only do they introduce oil into the materials which causes the "floating gold" problem mentioned above, but they also create turbulence which greatly interferes with smooth laminar flow.

5) ENERGY: Gold panning is a very tiring and some might call a backbreaking activity. Designs that save time and energy allow the panner to retrieve more gold by processing more materials in a given period of time or work longer without getting exhausted.

6) COMMERCIAL SUCCESS: Over the past 150 years or longer several problems have been recognized in gold panning and many designs have been proposed to solve them. Yet today most of all gold pans in daily use are almost identical to the ones available 200 years ago. They are round, have sloping sidewalls and a flat bottom. The only improvement that remains is that the most popular round pan in use today has some large riffles in only one section of it's sloping sidewalls.

There are three basic reasons why designed improvements have not lasted:

a) The designed improvements did not perform as well as anticipated.

b) The designed improvements created more problems than they solved.

c) The improved designs were too expensive to produce at a price acceptable to the marketplace.

OBJECTS AND ADVANTAGES a) To reduce the time and energy required to process a given volume of granular material by:

1) providing a gold pan that requires only one continuous motion from start to finish to achieve maximum concentration in the pan.

2) providing a gold pan that does not require stopping and starting of the concentration process.

3) providing a gold pan that does not require a separate motion or step for incremental washing of waste from the pan.

4) providing a gold pan with an internal design that accelerates the movement of gold particles into the desired area of concentration.

5) providing a gold pan with a desired area of concentration whose cubic volume is less than one tenth of one percent of the cubic volume of the entire pan.

6) providing a gold pan that holds the gold particles in the desired area of concentration once they get there and does not allow them to spill out again.

7) providing a gold pan which can process several loads of granular material before the gold is removed.

8) providing a gold pan where the gold can be removed through a bottom opening without first washing the waste materials off the concentrates.

9) providing a gold pan whose internal design creates smooth laminar flow and allows aggressive panning action without risk of losing fine gold particles.

10) providing a gold pan whose internal design promotes rapid concentration with smooth, straight, non-turbulent laminar flow of materials and no wasted energy.

11) Providing a gold pan that achieves higher concentration of gold in the pan.

12) Provide a gold pan where 100% of all internal surface areas slope downward and inward toward the desired area of concentration and nothing impedes the movement of gold particles toward that area.

b) To reduce to an absolute minimum the amount of time needed for a panner to become proficient with the gold pan—even a child.

c) To reduce the potential of losing fine gold from turbulence in the pan by controlling the internal design.

d) To reduce the potential of losing fine gold from oil in the pan by a design that never requires the panner to touch the inside of the pan.

e) To provide a gold pan that is light and durable yet one that can be economically produced and distributed at a price acceptable to the marketplace.

f) To produce a gold pan that is substantially rectangular with no bottom panel which has been the source of many problems in prior art.

g) To produce a gold pan that solves old panning problems without creating new ones.

h) To design a bottom opening and means for sealing that can be used with any pan design yet is simple to use and economical to manufacture.

Further objects and advantages of my gold pan will become apparent from a consideration of the drawings and ensuing description.

DRAWING FIGURES

Figure 9:
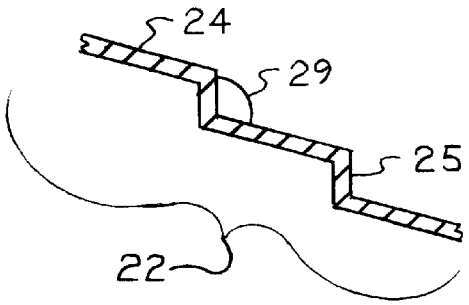

FIG. 9 is a cutout side view of the "plate 24 and edge 25" design of the sloping sides 22 showing the included angle 29 between the plates 24 and edges 25.

Figure 10:
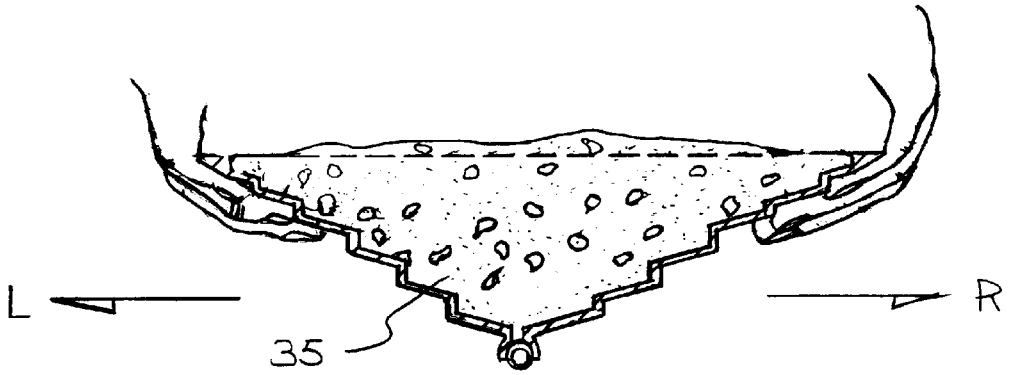

FIG. 10 is a pan filled with granular material.

Figure 11:
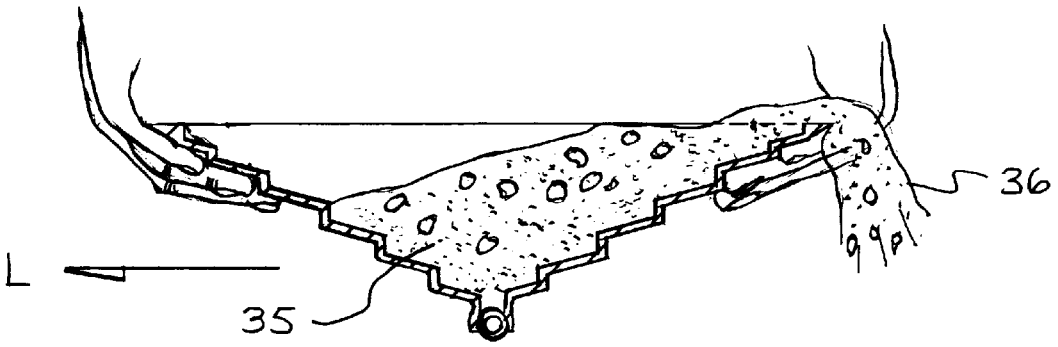

FIG. 11 is a pan being shaken so that waste materials spill over the side.

Figure 12:
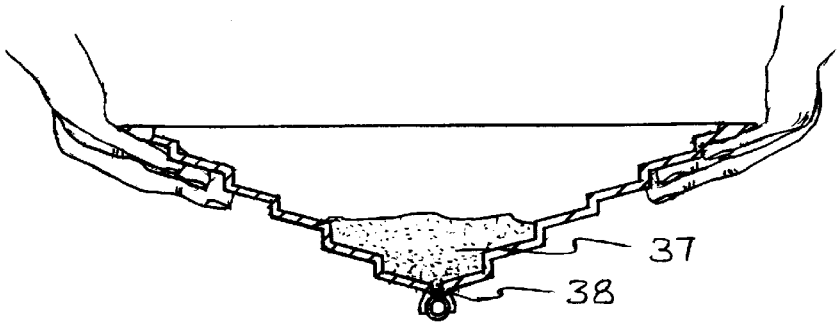

FIG. 12 is a pan 13 full of concentrates.

Figure 13:
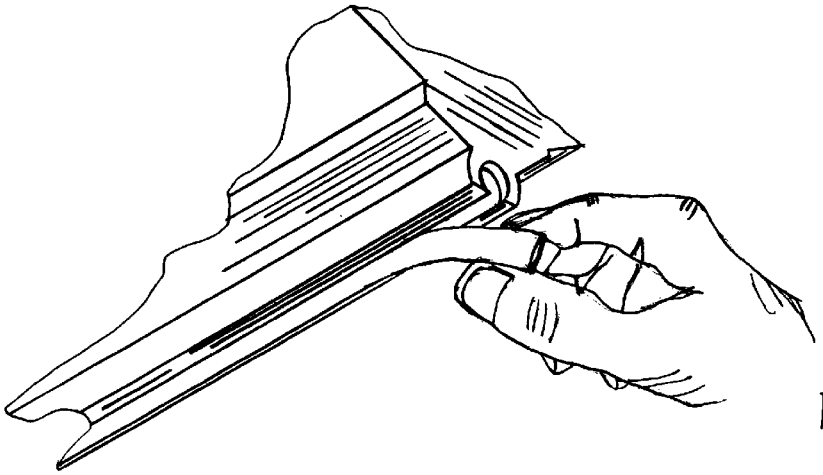

FIG. 13 shows the seal being removed.

Figure 14:
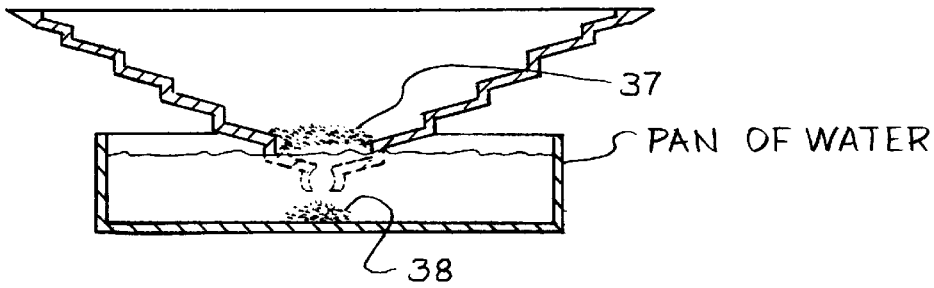

FIG. 14 shows washing the seal retainer stips.

Reference numerals in drawings:

20 Pan
21 vertical wall
22 sloping wall
23 bottom opening
24 plate
25 edge
26 retaining strip
27 angle between sloping side wall 22 and surface plane 34
28 seal
29 angle between plate and edge surfaces
30 tapered bottom joint
31 groove
32 notch
33 concentrating trap
34 surface plane
35 granular material
36 waste
37 black sand
38 gold concentrates

SUMMARY

The hand held classifying device or gold pan is a substantially rectangular pan that is easier to learn and to use than any prior art for the concentration of gold, platinum and other precious materials according to their relative specific gravities. It can recover more gold by processing more native granular materials in a given period of time, without losing fine gold, than with any prior art.

Said device achieves most of the objectives envisioned by prior inventors, but avoids the additional problems that each proposed improvement created. It produces the smoothest, turbulence free flow of materials in the pan and has no structure that would impede the concentration process. Its simple design allows it to be produced at a price acceptable to the market place.

Description—FIGS. 1 through 9

Figure 1:
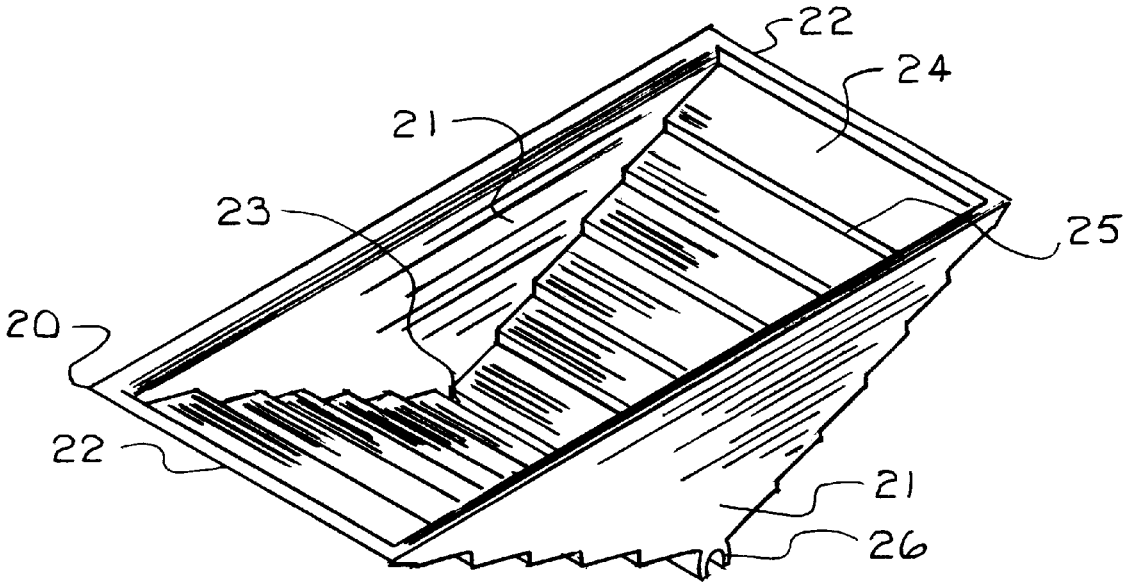
FIG. 1 is a view of the preferred embodiment from above and to one side from which all thenajor components of the device of the current invention can be seen.

A pan 20 as shown in FIG. 1 is a watertight vessel with an open and substantially rectangular top edge. From the side view shown in FIG. 3, it has the appearance of an inverted, substantially triangular shape. If rotated 90 degrees in either direction to see the other side it appears to have a substantially rectangular or "boxy" shape.

Figure 5:
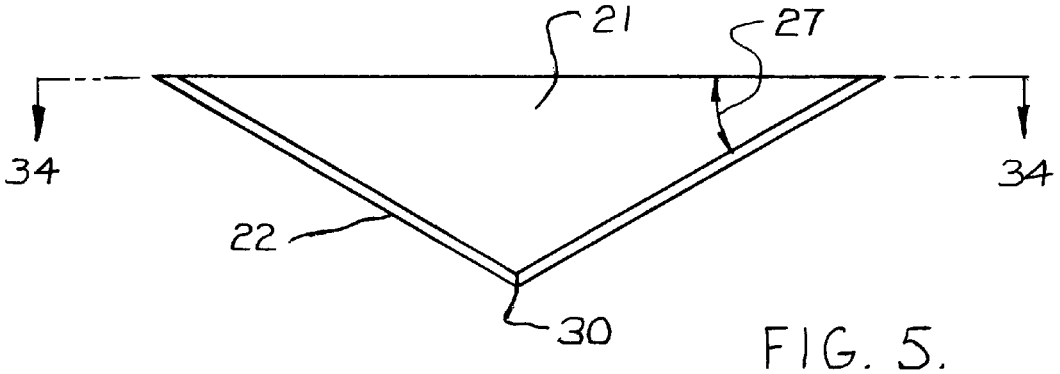
FIG. 5 is a side view of the most basic embodiment of the device of the present invention which utilizes only one opposing pair of substantially flat and substantially vertical sides 21 and one opposing pair of sloping sides 22, all pieces being sealed and joined along their matching edges to form a watertight container.
Figure 6:
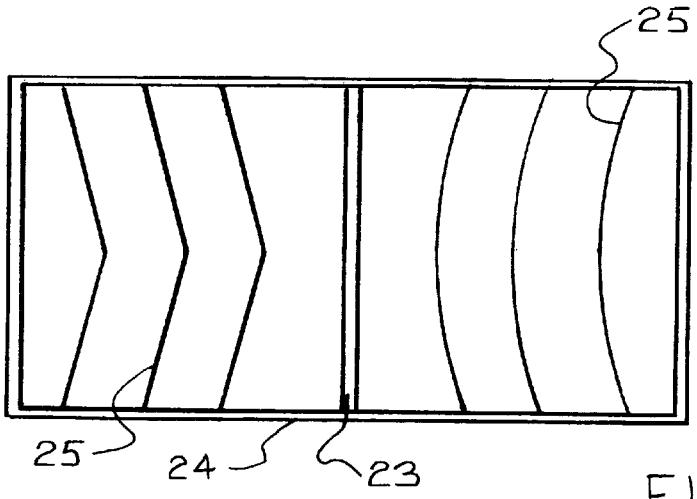
FIG. 6 shows possible variations from the straight lines of plate 24 and edge 25 pieces.

The basic embodiment of pan 20 requires only four pieces of material. Those four pieces are actually two each of only two designs. A vertical side wall 21 is triangular in shape as seen in FIG. 5. A sloping wall 22 is substantially rectangular in shape as seen in FIG. 1 but without the laminated construction show there.

The materials can be plastic, wood, metal or any other suitable rigid material that will maintain watertight integrity and not fracture under the weight of the gold panning process. All edges join at substantially right angles so no special shaping is required except perhaps where sloping sides 22 join at the bottom center of pan 20 as shown in FIG. 5. This is a tapered bottom joint 30.

Glue, nails, screws or any other suitable material may be used to join the four pieces into a rigid, watertight vessel. Pan 20 can be made at one time in a plastic molding process.

The size of pan 20 can be varied to suit the needs of various people. The most important consideration is the volume of materials that a panner can handle over an extended period of time without encountering undue fatigue.

The length, width and height of pan 20 can have wide variations to accommodate the desired volume. Over two years of testing has shown that the most desirable dimensions are 14" to 15" long by 6" to 7" wide and 4" to 4½" deep.

Length is defined as the length of the base dimension of inverted, triangular shaped vertical wall 21. Width is defined as the perpendicular distance between the two vertical walls 21. Depth is defined as the perpendicular height between the base of triangular shaped vertical wall 21 and its peak at the bottom of pan 20.

The four walls need not be perfectly flat when viewed across their width or length. They could also be somewhat concave or convex. However, in testing the flat surfaces have shown to produce the smoothest laminar flow with little or no turbulence. As discussed in prior art, turbulence and less than perfect laminar flow increases the risk of losing gold while consuming additional energy yet adding no benefit to the panning process.

Vertical sidewalls 21 can be made slightly downwardly and inwardly converging for two reasons. First, this shape makes manufacturing easier and less costly when utilizing a plastic molding process. Pan 20 is easier to get out of the mold and there is less potential for damage. Second, pan 20 can be nested for economies of shipping and handling. Nesting also strengthens pan 20 against possible damage in handling as opposed to individual packaging.

This basic design is extremely simple and easy to make yet it enables the panner to process more materials in a shorter period of time and with less fatigue than with any other design in existence today.

When the panner washes waste materials out of pan 20 the gold particles will stay in the desired area of concentration and not move. The desired area of concentration is where sloping walls 22 meet at the bottom of pan 20.

Where the four sidewalls meet in the bottom of pan 20 is the only place in pan 20 where movement of granular materials is severely restricted. Any materials on top of the gold concentrates will hold them there and not let them shift out.

The preferred embodiment of pan 20 includes two improvements that reduce the time and energy required to process a given volume of granular material. These improvements allow the panner to recover even more gold in a given period of time than with the unimproved, basic design.

Figure 3:
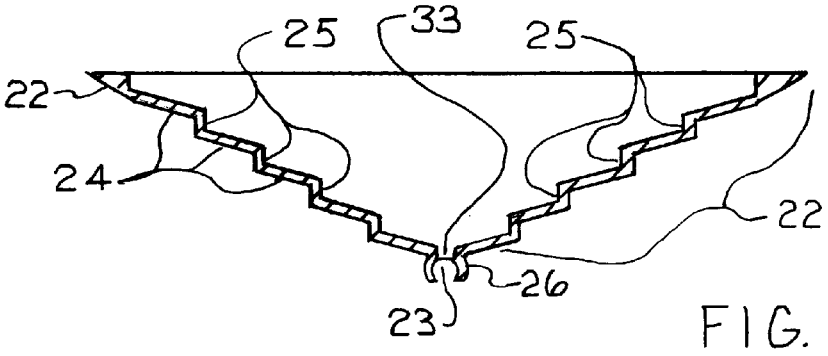
FIG. 3 is a side view of the preferred embodiment of the device of the present invention showing the stepped appearance of the laminated construction in the two sloping side walls 22.
Figure 4:
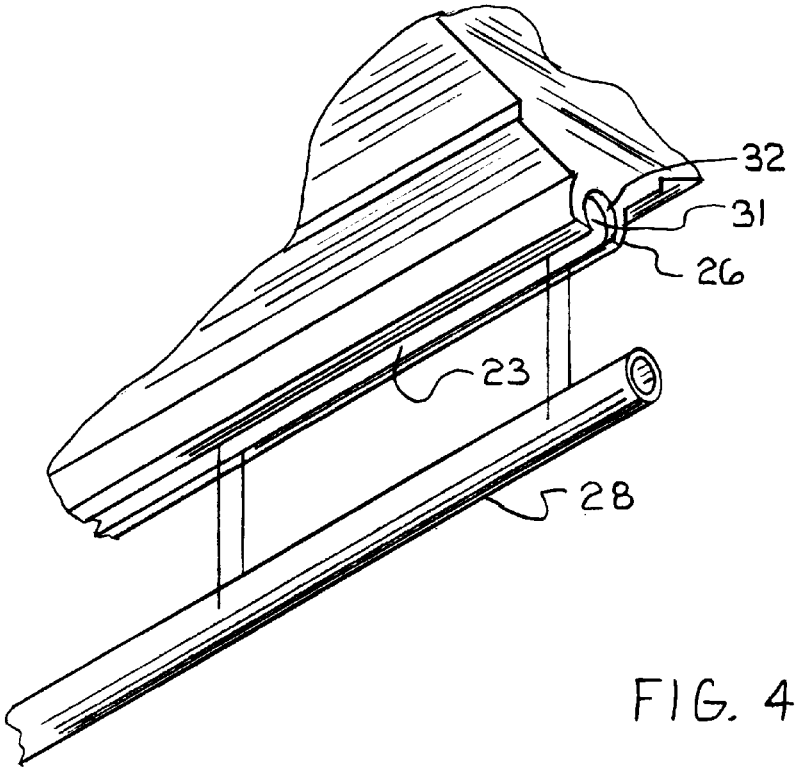
FIG. 4 is a cutout view of the bottom of the pan showing the preferred embodiment of the bottom opening with the seal 28 and the seal retainer strips 26.

The first improvement to the basic pan 20 design is the inclusion of a bottom opening 23 as shown in FIGS. 1, 3 and 4. This allows the panner to quickly and easily remove gold concentrates through the bottom of pan 20 without first washing all waste materials out of pan 20. Then all other unwanted materials can be dumped out of pan 20 in one single motion.

To create opening 23 when assembling parts or molding pan 20 it is only necessary to not let the bottom ends of sloping sides 22 meet or join. Let the bottom ends of sloping sides 22 be apart by about ½ inch or less. This creates a substantially rectangular opening 23 in the bottom of pan 20 that extends perpendicularly to each vertical sidewall 21 at the bottom point of its triangular shape.

Figure 7:
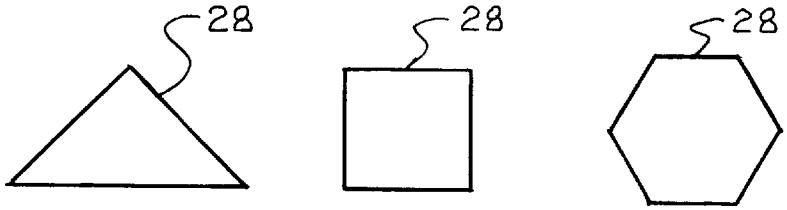
FIG. 7 shows possible geometric variations in the shape of the bottom seal 28 in the preferred embodiment which might be needed to match with alternate shapes in the seal retainer strips 26.
Figure 8:
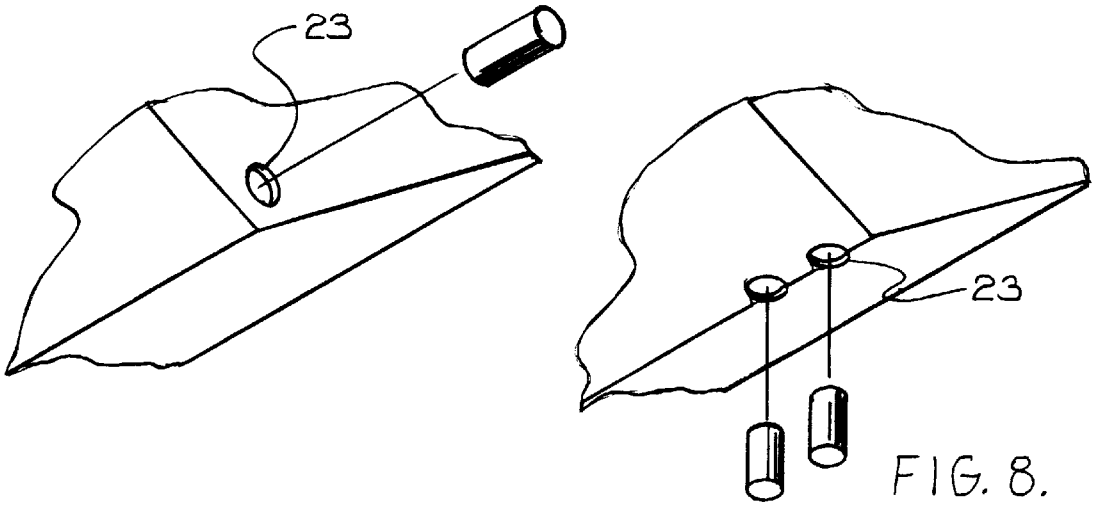
FIG. 8 shows possible variations in the design of the bottom opening 23 and the matching means of sealing the openings.

Opening 23 creates the need for a seal 28 as shown in FIG. 4. The preferred embodiment utilizes a round tubular seal 28. However, as shown in FIG. 7 almost any geometrical shape either solid or hollow may be used for seal 28 to create a watertight pan 20, as long as it matches a groove 31 as shown in FIG. 4 which is part of a retaining strip 26 as shown in FIG. 4.

To use pan 20 in its preferred embodiment seal 28 must protrude beyond the outside of vertical wall 22 so that the panner can grasp the end of seal 28 from either side of pan 20. This requires that vertical side wall 22 have a notch 32 as seen in FIG. 4 which will match the shape of seal 28.

Strip 26 can be made from the same material as vertical side wall 21 and sloping sidewall 22. With a drill, router, lathe or other suitable tool cut groove 31 in a small strip of material which then becomes strip 26. Two are needed for fabricated pan 20. The shape of groove 31 should match the shape of seal 28 sufficiently to create watertight pan 20 when completely assembled.

Strip 26 should be attached to the bottom edge of sloping side 22 and be perpendicular to vertical side 21. Attachment can be made with any material or device that will create a rigid, watertight pan 20.

The grooves 31 in strips 26 should face each other to form a suitable cavity for receiving and holding seal 28 to create watertight pan 20. At no place should any part of strips 26 have a shorter perpendicular distance between them than the perpendicular width of opening 23. Any granular material that passes through opening 23 should be able to pass between strips 26.

When making pan 20 by plastic molding strips 26 and all other parts of pan 20 can be created in one operation, except for seal 28.

Figure 2:
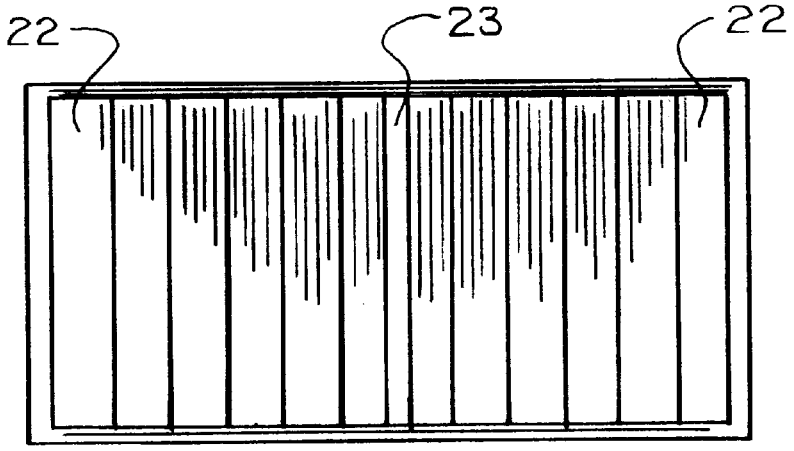
FIG. 2 is a top view of the preferred embodiment of the device of the present invention showing the top outline and the laminated construction of the two sloping walls 22.

The second improvement to the basic pan 20 design is the laminated construction of sloping side 22 as shown in FIGS. 1, 2 and 3. A plate 24 and an edge 25 provide a surface that continuously slopes downward and inward toward opening 23. There is nothing on any of these surfaces that would impede the movement of gold toward opening 23.

An angle between plate 24 and edge 25 surface 29 as seen in FIG. 9 can vary widely but for economies of plastic molding operations it will be approximately equal to or greater than 90 degrees plus an angle between sloping side wall 22 and a surface plane 34, 27 as seen in FIG. 5. Surface plane 34 is the common geometric plane where all four walls terminate at the top of the pan.

To produce the laminated construction of sloping wall 22 you need only use several short pieces of material in place of the single piece in the basic design. Let the lower edge of each successive short piece of material rest on the upper side of the next lower short piece of material until the desired length is achieved to produce sloping wall 22 as seen in FIGS. 1, 2 and 3.

A piece of gold will move down along smooth plate 24 surface until it falls down smooth edge 25 surface. This sequence will be repeated until the gold particle comes to rest in opening 23 and on top of seal 28. At no time will the gold particle encounter any designed feature of pan 20 that will retard its movement toward opening 23.

The lowest edge 25 of each sloping wall 22 combines with two vertical walls 21 to form a concentrating trap 33 that is substantially rectangular with four substantially vertical sidewalls. Seal 28 forms the bottom of trap 33 making it a watertight container. Trap 33 has a cubic volume of less than one-tenth of one-percent of the cubic volume of pan 20. A similar trap 33 can be constructed in the basic embodiment by making strips 26 slightly wider than is needed to contain groove 31. The extra width becomes the walls of trap 33.

A particle of gold reaching trap 33 is held there. All surfaces outside trap 33 slope downward and inward toward trap 33. All walls of trap 33 are substantially vertical. Trap 33 becomes a strong container for keeping the gold there. Because of the small cubic volume of trap 33 the gold there is highly concentrated.

Operation—FIGS. 10 through 14

To operate gold pan 20 simply fill it nearly to the top with desired granular materials 35 as seen in FIG. 10. Remember that pieces of gold are small and much more material can be processed and more gold recovered by first screening large waste pieces out of your native supply of materials. A one-half inch opening screen or even a one-quarter inch screen is very appropriate in most gold panning areas.

Grasp pan 20 on the outside at the upper ends of sloping sides 22 as seen in FIG. 10. It is not necessary or even desirable to touch the inside of pan 20 with your hand or fingers. Touching the inside of pan 20 increases the likelihood of losing fine gold.

Holding pan 20 level submerge it in water until if fills with water. Begin by shaking pan 20 from left to right with short smooth movements. You can do this by simply flexing your wrists. The gold in the top layers of material will sink very rapidly leaving only lighter waste materials 36 at or near the surface. These lighter materials will move almost as easily as the water.

Gradually increase the speed of shaking and the length of the left and right movements. Waste materials 36 will begin to spill out over the ends of sloping sides 22, both around your hands and between your fingers as seen in FIG. 11. It is not necessary to change the motion of pan 20 except to speed up or slow down or to increase or decrease the length of the stroke from side to side.

As waste materials 36 disappear from pan 20 the gold moves continuously toward opening 23. Maximum concentration can occur when pan 20 is still one-third to one-half fill of granular materials 36 and black sand 37 as seen in FIG. 12. Ideal concentration will occur much more quickly than with other pan designs because once started, you never have to stop shaking until concentration is completed. Once the material is liquefied you keep it liquefied until concentration is complete. Movement of gold downward and inward to opening 23 is continuous.

The only variation to this technique is one used to wash out waste materials 36 more quickly without expending additional energy. As pan 20 is moving from side-to-side if you allow the hand through which waste materials 36 are washing out of pan 20 to drop slightly lower than the other hand more waste material 36 will wash out of pan 20 on each stroke without expending any additional energy.

From the discussion of prior art you may remember that when you liquefy the mixture of granular materials 35 and water by shaking pan 20 the particles of gold move downward through the material until they come in contact with a surface of pan 20. Vertical wall 21 never provides any resistance to the movement of gold particles downward.

While shaking pan 20 from side-to-side the mixture of water and granular materials 35 tend to flow-up one sloping wall 22 while flowing down the opposite sloping wall 22. When the direction of your stroke reverses the mixture flows back down the first sloping wall 22 and up the other.

Descending gold particles form a thin, heavy concentrate layer on sloping wall 22. The heavy materials move down sloping wall 22 just as easily as any other materials in pan 20. However, when the mixture flows back up sloping wall 22, a combination of higher specific gravity and friction tends to resist the movement of the heavy gold particles so that lighter waste materials 36 move up and over them. Each cycle of side-to-side movement of pan 20 brings the heavier gold concentrates closer to opening 23 and the lighter waste materials 36 closer to the top.

In the improved design which is the preferred embodiment of pan 20 you have the laminated or plate 24 and edge 25 design of sloping wall 22. The mixture flows down the plate 24 and edge 25 surfaces as easily as it does in the basic design using one flat piece for sloping wall 22. However, when the materials flow back up sloping wall 22 with the laminated design, edge 25 surfaces create miniature walls that cause a greater resistance to the gold concentrate layer moving back up sloping side 22 while waste materials 36 move easily up and over the gold concentrates.

The laminated plate 24 and edge 25 design of sloping wall 22 speeds up the panning process by reducing the number of side-to-side motions required to move the gold concentrates 38 to opening 23. This reduces fatigue by reducing the energy needed to process a given volume of materials. More materials can be processed and more gold recovered in any given period of time than with other pan designs.

Edge 25 surface is perpendicular to vertical side 21 and runs across sloping side 22 in a line that is parallel to surface plane 34 of pan 20. When the mixture moves up and down sloping side 22 it flows at a constant depth all across plate 24 and edge 25 surfaces. The laminar flow is smooth and there is little or no turbulence.

When the desired level of concentration is reached the gold concentrates 38 can be removed directly through the bottom of pan 20. Simply stop the shaking to allow materials in pan 20 to settle into a tightly packed mass. Then tilt pan 20 gently to allow excess water to drain out of pan 20. The gold in opening 23 will stay there and not spill out.

Hold pan 20 over a second receptacle and with a thumb and finger simply pull seal 28 down and out of strips 26 as shown in FIG. 13. It is best to have some water in the second receptacle. By dipping strips 26 into the water as seen in FIG. 14 all granular materials will be flushed out of strips 26 so that they will be clean for reinserting seal 28.

Some panners like to save their black sand 37. While seal 28 is still out of pan 20 and after the gold concentrates 38 have been caught in a second container, the black sand 37 can be emptied into a third container that has water in it. Simply dip the bottom of pan 20 into the water in the third container. As far as the water reaches up into pan 20 the black sand 37 will fall out and into the third container. The remaining waste materials 36 can then be discarded with one motion of pan 20.

Because there is such a small amount of gold in each pan 20 it is not necessary to empty the gold concentrates 38 through opening 23 with each pan 20 processed. When pan 20 is down to one-quarter or one-third full or when you see black sand 37 in pan 20 just refill pan 20 and continue shaking. In some gold panning areas you might process 5 to 10 gallons of native materials before removing concentrates 38 through opening 23.

With this procedure you will be able to process more material in a shorter period of time. Final separation of gold will be much faster also because there is more gold and less waste 36 in the concentrates you recover.

Conclusion, Ramifications and Scope

Accordingly, the reader will see that the device of the present invention allows a panner with little or no prior experience to achieve proficiency in gold panning in a matter of minutes rather than hours, weeks or months. Its unique design and preferred method of operation enable a panner to process much more material in any given time period than can be processed with current art forms.

It provides a design that actually accelerates the movement of gold toward the desired area of concentration and reduces the amount of shaking needed to achieve full concentration.

it lets a panner achieve proficiency of operation by learning only one side-to-side motion.

it lets almost all the panners energy go toward concentration by eliminating all washing cycles and all but the first liquefying cycle.

it prevents reversal of concentration which occurs with current art forms when gold moves away from or spills out of the desired area of concentration during the tilting required in wash cycles.

it provides the smallest area of concentration which gives the highest degree of concentration when compared to existing art forms.

it provides an inner pan surface where 100% of all surface areas slope downward and inward toward the small area of concentration and there are no surface features that offer any resistance to the movement of gold to the area of concentration.

it provides a bottom opening whereby highly concentrated materials can be removed directly from the pan while leaving all wastes behind.

it produces a more highly concentrated material thereby saving time in the secondary finishing process.

it almost completely eliminates turbulence from the laminar flow of materials.

it eliminates the need to touch the inside of the pan which can leave oil to float fine gold out of the pan.

it provides a design that can be manufactured in one step in a plastic molding process so that the cost is acceptable to the market place.

it eliminates the need for a bottom panel in a rectangular pan which is the source of many problems and the reason for much wasted time and energy in current art forms.

The reader will also see that the design of the bottom opening and means for sealing are simple enough and economical enough to be a significant improvement to any current art and to many future designs.

Although the descriptions in the preceding writings contain many specificities, these should not be construed as limiting the scope of the invention but as merely providing illustrations of some of the presently preferred embodiments of the invention. For example, the size, length, width and depth can vary; there can be multiple bottom openings; there can be many geometric shapes for the seals and retaining strips so long as watertight integrity is preserved; the seal can be permanently attached by a hinge or other means; the side walls, the plates and edges and the cavity walls can be flat or have some degree of concave or convex shape; the vertical side walls can converge slightly to allow nesting in shipment; the angles between the plates and edges and between the sloping side walls and the pans surface can vary significantly from pan to pan; the length, spacing, and number of plates and edges can vary; there can be various ribs, ridges or supports added to the outside of the pan to improve gripping, physical strength or support for the pan when not being held; etc.

Thus the scope of the invention should be determined by the appended claims and their legal equivalents, rather than just by the examples given.

What I claim and desire to secure by Letters of Patent of the United States is:

1. A gold pan for classifying granular material contained in a liquid slurry according to their relative specific gravity, the pan comprising:

a. A pair of opposite side walls that are flat and substantially vertical to reduce turbulence in the pan; and b. a second pair of sloping side walls that converge downwardly and inwardly and are bonded with the pair of opposite side walls to form a watertight pan without a bottom panel, such four walls containing no design features that would create turbulence in the slurry or resist the movement of gold particles downward and inward toward the lowest point of the pan.

2. The gold pan of claim 1 further including a concentrating cavity located at the lowest point of joining of the four walls and having a cubic volume of about one-tenth of one percent of the total cubic volume of the entire pan, such cavity to receive and hold the gold in a highly concentrated condition.

3. The gold pan of claim 2 further including a bottom opening with a seal that can be easily pulled out and pushed in for closing the opening such that all gold concentrates can be removed through the bottom of the pan in one easy operation while all waste materials remain in the pan.

4. The gold pan of claim 3 further including a laminated or plate and edge construction of the sloping side walls, such laminated construction increasing the speed and ease of getting the gold into the concentrating cavity by providing no resistance to gold particles moving down toward the concentrating cavity yet providing a substantial resistance to gold particles moving up and away from the concentrating cavity.

5. The gold pan of claim 1 further including a bottom opening with a seal that can be easily pulled out and pushed in for closing the opening such that all gold concentrates can be removed through the bottom of the pan in one easy operation while all waste materials remain in the pan.

6. The gold pan of claim 5 further including a laminated or plate and edge construction of the sloping side walls, such laminated construction increasing the speed and ease of getting the gold into the concentrating cavity by providing no resistance to gold particles moving down toward the concentrating cavity yet providing a substantial resistance to gold particles moving up and away from the concentrating cavity.

7. The gold pan of claim 1 further including a laminated or plate and edge construction of the sloping side walls, such laminated construction increasing the speed and ease of getting the gold into the concentrating cavity by providing no resistance to gold particles moving down toward the concentrating cavity yet providing a substantial resistance to gold particles moving up and away from the concentrating cavity.

8. The gold pan of claim 2 further including a laminated or plate and edge construction of the sloping side walls, such laminated construction increasing the speed and ease of getting the gold into the concentrating cavity by providing no resistance to gold particles moving down toward the concentrating cavity yet providing a substantial resistance to gold particles moving up and away from the concentrating cavity.

* * * * *